United States Patent [19]

Jones et al.

[11] Patent Number: 4,962,817

[45] Date of Patent: Oct. 16, 1990

[54] ACTIVE REFERENCE SYSTEM

[75] Inventors: Arthur B. Jones, Pasadena, Tex.; Thomas D. Cherbonnier, Singapore, Singapore

[73] Assignee: A.R.M. Design Development, Singapore

[21] Appl. No.: 331,752

[22] Filed: Apr. 3, 1989

[51] Int. Cl.[5] ..... E21B 19/09; B63B 35/44; B66F 11/04

[52] U.S. Cl. ..... 175/5; 166/355; 175/27; 175/40

[58] Field of Search ..... 166/355; 175/7, 5, 27, 175/85; 405/195; 254/900, 277

[56] References Cited

U.S. PATENT DOCUMENTS

| | | | |
|---|---|---|---|
| 3,158,208 | 11/1964 | Kammerer | 175/5 X |
| 3,721,293 | 3/1973 | Ahlstone et al. | 175/5 X |
| 3,793,835 | 2/1974 | Larralde | 175/5 X |
| 3,912,227 | 10/1975 | Meeker et al. | 175/5 X |
| 3,940,111 | 2/1976 | Castela et al. | 175/5 X |
| 4,576,517 | 3/1986 | McCann et al. | 175/7 X |
| 4,632,183 | 12/1986 | McLeod | 166/77 |
| 4,662,786 | 5/1987 | Cherbonnier | 405/195 |

*Primary Examiner*—Stephen J. Novosad
*Attorney, Agent, or Firm*—William W. Haefliger

[57] ABSTRACT

A motion compensation system is provided for use on a drilling vessel that is subject to heaving due to wave action, and wherein a motion compensator associated with a derrick supports a drill string that extends from the vessel downwardly through the seabed and into a drilled hole in the sub-sea formation, the system including a first encoder for sensing vertical motion of the vessel, due to sea heaving, and for producing an electrical signal that varies in response to such sensing, a device on the vessel for producing hydraulic fluid displacement corresponding to variations of the signal, and an hydraulic fluid responsive manipulator in the form of an actuator or actuators carried by the derrick for lifting and lowering the compensator in correspondence to such hydraulic fluid displacement, thereby to maintain the drill string substantially motionless, vertically.

9 Claims, 5 Drawing Sheets

ACTIVE REFERENCE SYSTEM

BACKGROUND OF THE INVENTION

This invention relates generally to motion compensation, and more particularly to improvements in heavy duty compensating devices making them simpler, more effective and reliable. More specifically, it concerns multiple actuators and control mechanisms therefor.

There is need on floating offshore drilling vessels for simple, effective, reliable, heavy duty, motion and load compensating equipment, to compensate for and nullify forces exerted as a result of deck "heave" on a vessel. A floating offshore drilling vessel cannot inherently provide a constantly stable platform as related to the subsea wellhead or bore hole. In this regard, a stable reference is required for landing and retrieving of wellhead and blowout prevention equipment, control of string weight on the drill bit in the hole, landing of casing and liner, coring, well logging, and tool fishing. There is need for nullification of the effects of rig/platform heave in response to swelling seas, and for compensating apparatus that will maintain a predetermined lifting force.

Prior Drill String Compensators (D.S.C.'s), sometimes called heave compensators, are of two types:

1. Block mounted, or
2. Crown mounted

Block mounted compensators substantially increase the weight applied to the draw works, require precise alignment of derrick track and dollies, and represent a substantial change in the deck loading arm by their movement up and down the derrick.

Crown mounted compensators overcome these major disadvantages but still add a significant weight to the crown of the derrick. These two methods share some common disadvantages:

1. Stroke/compensation length is equal to rod length or must incorporate chains and sheaves which add additional wear/failure areas.
2. Rig heave compensation causes compression or expansion of compressed air, which in turn causes an inverse reaction in the compensating force applied.

There is also need for a heave tracking system to control drill string compensation.

SUMMARY OF THE INVENTION

It is a major object of the invention to provide a compensation system meeting the need as referred to, and overcoming disadvantages of prior compensators and compensation systems. Basically, the system of the invention comprises:

(a) first means for sensing vertical motion of the vessel, due to the heaving, and for producing a signal that varies in response to said sensing, (b) second means on the vessel for producing hydraulic fluid displacement corresponding to varying of the signal, (c) and hydraulic fluid responsive actuator means carried by the derrick for lifting and lowering the compensator in correspondence to hydraulic fluid displacement.

Existing compensators typically include cables and pulleys, and a frame supporting such cables and pulleys to support the drill string, and the actuator means herein includes at least two vertical actuators each including cylinder and plunger elements, one of the elements connected to the derrick and the other of the elements connected to the existing frame.

The second means as referred to advantageously includes an hydraulic fluid pump, and a four-way directional control valve connected between the pump and the actuator means for controllably delivering pressure to opposite ends of the actuators in response to shifting of the valve which is so shifted in response to variations in the electrical signal.

Another object includes provision of an improved compensator itself, which includes interengaged pinion gear and vertical rack elements, one of the elements carried by the derrick and the other of the elements supporting the drill string, the actuator means operatively connected to the pinion gears. A further modified form of compensator includes nut and vertical screw elements, one of the elements carried by the derrick, and the other of the elements supporting the drill string, the actuator means operatively connected to the screw element or elements to rotate same.

Oscillation restraint means may be operatively connected with the screw element or elements to restrain lateral oscillations thereof.

It is a further object to provide improved actuators as referred to, which are single-ended, and which include telescoping piston and cylinder members, the piston member being cylindrical to telescopically receive a central plunger carried by the cylinder member.

These and other objects and advantages of the invention, as well as the details of an illustrative embodiment, will be more fully understood from the following specification and drawings, in which:

DRAWING DESCRIPTION

Figure 5:
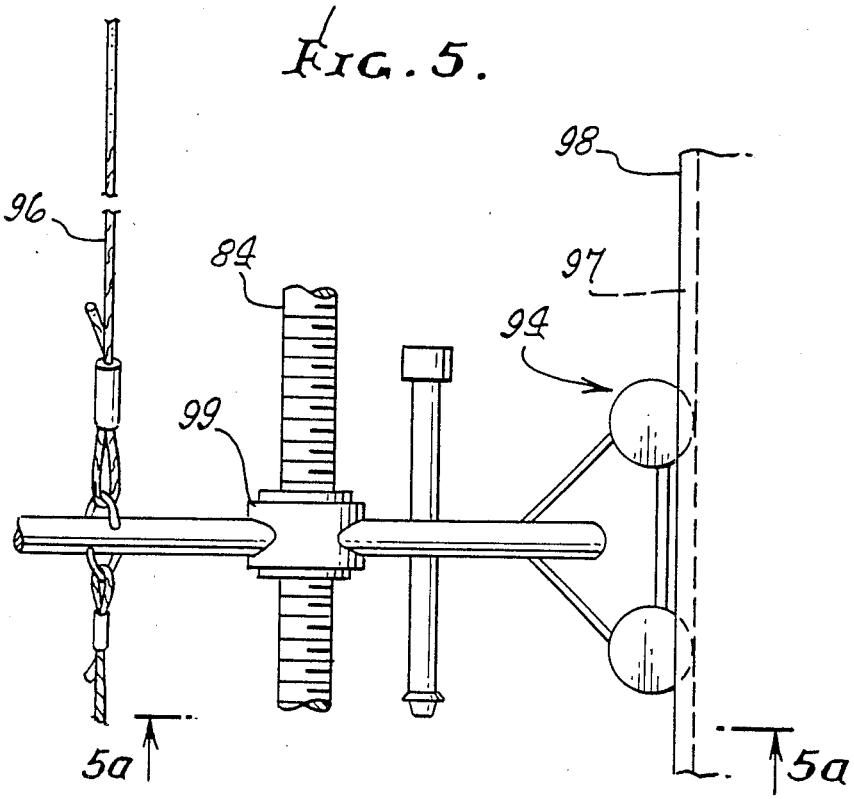
FIG. 5 is an elevation showing a method of screw oscillation restraint.
Figure 5A:
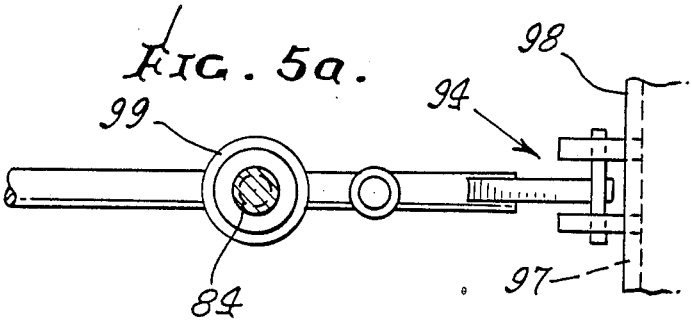

FIG. 5*a* is a view taken on lines 5*a*—5*a* of FIG. 5; and

Figure 1:
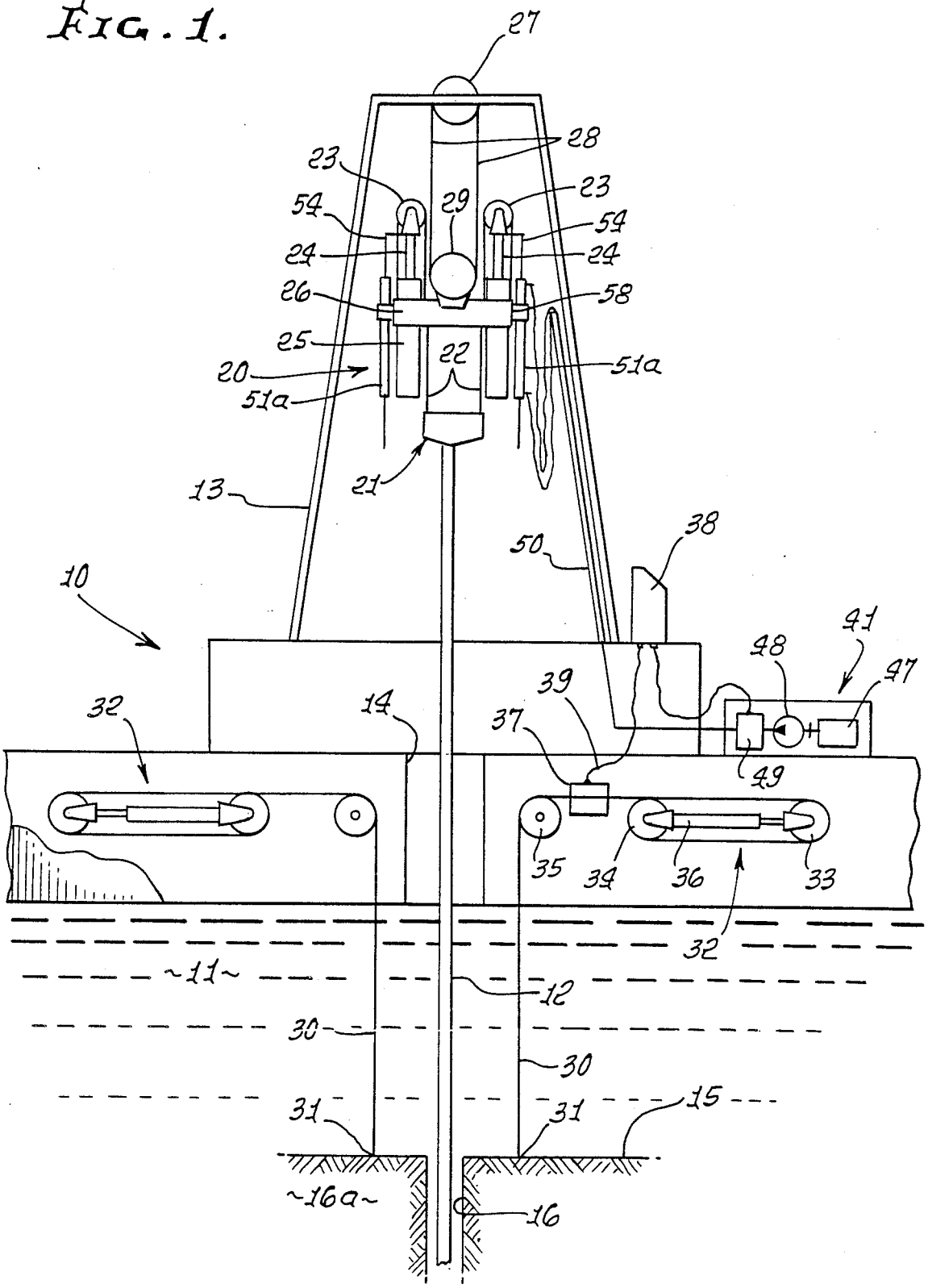
FIG. 1 is an elevation showing a form of the invention employing double ended cylinder actuators to support and displace a drill string motion compensator, in response to vessel heave.
Figure 6:
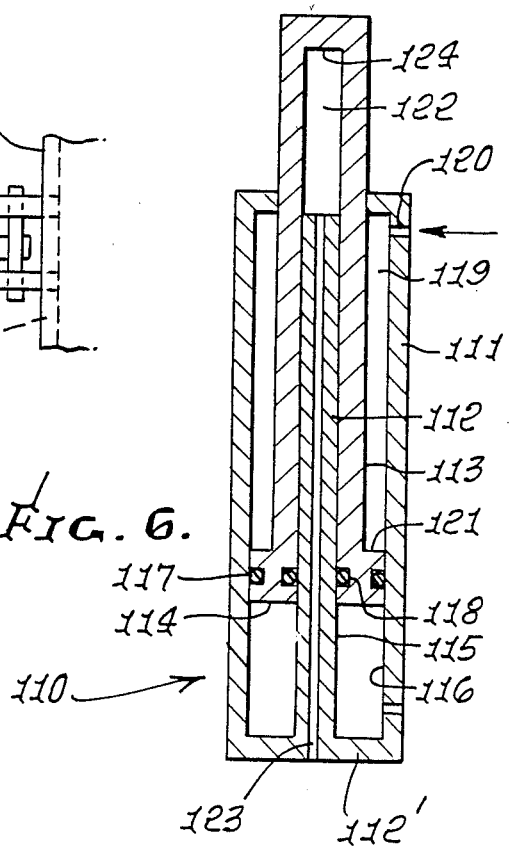

FIG. 6 is a section taken through a single-ended cylinder actuator, usable in FIG. 1.

DETAILED DESCRIPTION

Referring to FIG. 1, an offshore drilling vessel 10 floats on the sea 11 and suspends pipe (or tubing) such as drill string 12 from a derrick 13 on the vessel. The string passes downwardly through a "moon hole" 14 on the vessel, to and beneath the seabed 15, via a bore hole 16, into the sub-sea formation 16*a*.

An existing compensator unit 20 includes a structure 21 supporting the string as via cables 22. The latter entrain sheaves 23 on actuator rods 24 movable relative to actuator cylinders 25 attached to cross frame 26. The latter is suspended from the derrick via a top sheave 27, and cables 28, and an auxiliary sheave 29.

Elements of the invention include:

Item 30—Guideline or riser tensioning line, used to generate the vessel motion signal by establishing a fixed seabed reference. See attachment of line 30 to bed 15, at 31.

Item 32—Guideline or riser tension device used on the vessel to maintain a specified tension of the guideline or riser tensioner line. Tension sheaves 33 and 34 entrain the line 30, after it feeds over pulley 35. Actuator 36 keeps line tension constant. Two devices 32 and lines 30 are used, for balance.

Item 37—Motion encoder or transducer operating to encode mechanical motion into an electronic signal. It measures displacement, velocity, acceleration and direction of cable travel (translates to vessel vertical motion relative to the seabed). Cable 30 passes through or adjacent the encoder 33, which is mounted on the vessel.

Item 38—Signal processor, which is connected at 39 to the encoder and operates to filter, process and amplify the electronic signal into a driving signal for the proportional servo hydraulic system 41.

Item 41—Hydraulic power unit, complete with reservoir 47, motor 48, pump 49, and servo valves, as shown. Hydraulic system is closed loop-type with pressure and flow compensated pump 49, four way directional control valve 43, cross port relief 44, and selectable open center option 45 to allow passive operation of closed loop. See FIG. 2.

Item 50—Hydraulic stand pipe attached to derrick. Fixed piping stand pipe allows connection between hydraulic power unit 41 and compensator manipulator actuators 51 that incorporates cylinder 25.

Item 51—Compensator manipulator actuators in the form of two hydraulic, double ended cylinders 51*a* attached at 58 to the main frame 26 of the compensator. The actuator rod ends 54*a* are attached to the rods 24 of the compensator itself (compensated portion).

The control system functions in the following manner: As the vessel heaves on the sea, the relative motion of the vessel and the guidelines or riser tensioning lines 30 is sensed by the encoder device. An electronic signal is generated that is related to the direction of travel, velocity, acceleration, and amplitude of the motion. That signal is sent to the processor 38 where the signal is interpreted, filtered and amplified into a control signal for the hydraulic system. In turn, the hydraulic system responds to the signal and directs the manipulator in response thereto. The manipulator then moves the compensator in a direction as required to maintain no relative movement of the drill string. This requires that the compensator be pressured such that it supports the entire suspended weight. In this instance, the manipulator must only produce enough force to overcome the seal friction and inherent force fluctuations of the compensator. The manipulator force is felt by the compensator as an increase or decrease in its suspended load which will respond accordingly.

Figure 2:
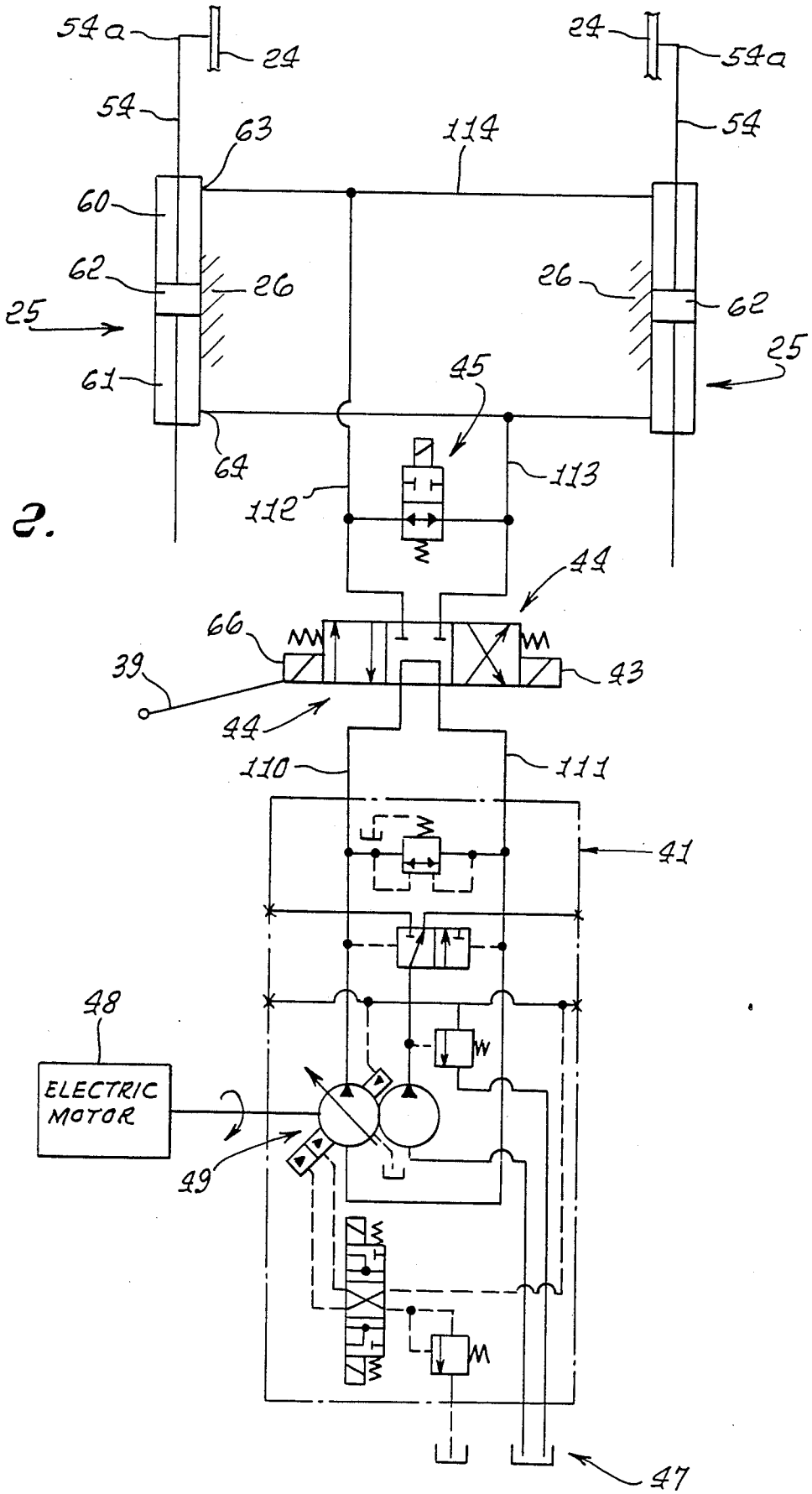
FIG. 2 is a diagram of a control system for the FIG. 1 actuators.

In addition, a simplified hydraulic schematic of the system is seen in FIG. 2. The components of the hydraulic system and their functions are as described below:

Item 51*a*—Hydraulic cylinders. These cylinders are double acting and of double-ended design. The double-ended design allows for equal volume requirements for both directions of travel. Note chambers 60 and 61 at opposite sides of piston 62 and ports 63 and 64.

Item 45—Passive option valve. This valve, when de-energized, will open the cylinder loop, allowing passive operation of the cylinders by free oil displacement.

Item 43—Four-way directional control servo valve or directional control valve. This valve responds to the electronic signal from the encoder and a solenoid 66 to shift laterally and meter the direction of the oil required to manipulate the cylinders.

Item 49—Pump. The ideal pump is a pressure and flow compensated variable displacement device. It can meter the pressure and volume of the oil delivered to the system as well as minimize the power consumed by the system. The pump is fitted with a "charge pump" that ensures that the system always has the oil it requires, thus eliminating the requirement of a large reservoir. This type of pump will also minimize the heat generated in the hydraulic system by accurately metering the flow requirements. Hydraulic lines to and from the actuators are seen at 110–115.

The twin double ended cylinder method is the simplest form of Active Compensation Manipulation for a retrofit installation to existing equipment. However, it is recognized that the active compensation manipulation is establishing a relative position between a fixed platform and a movable platform. New unit construction can best be achieved by alternate methods.

Figure 3:
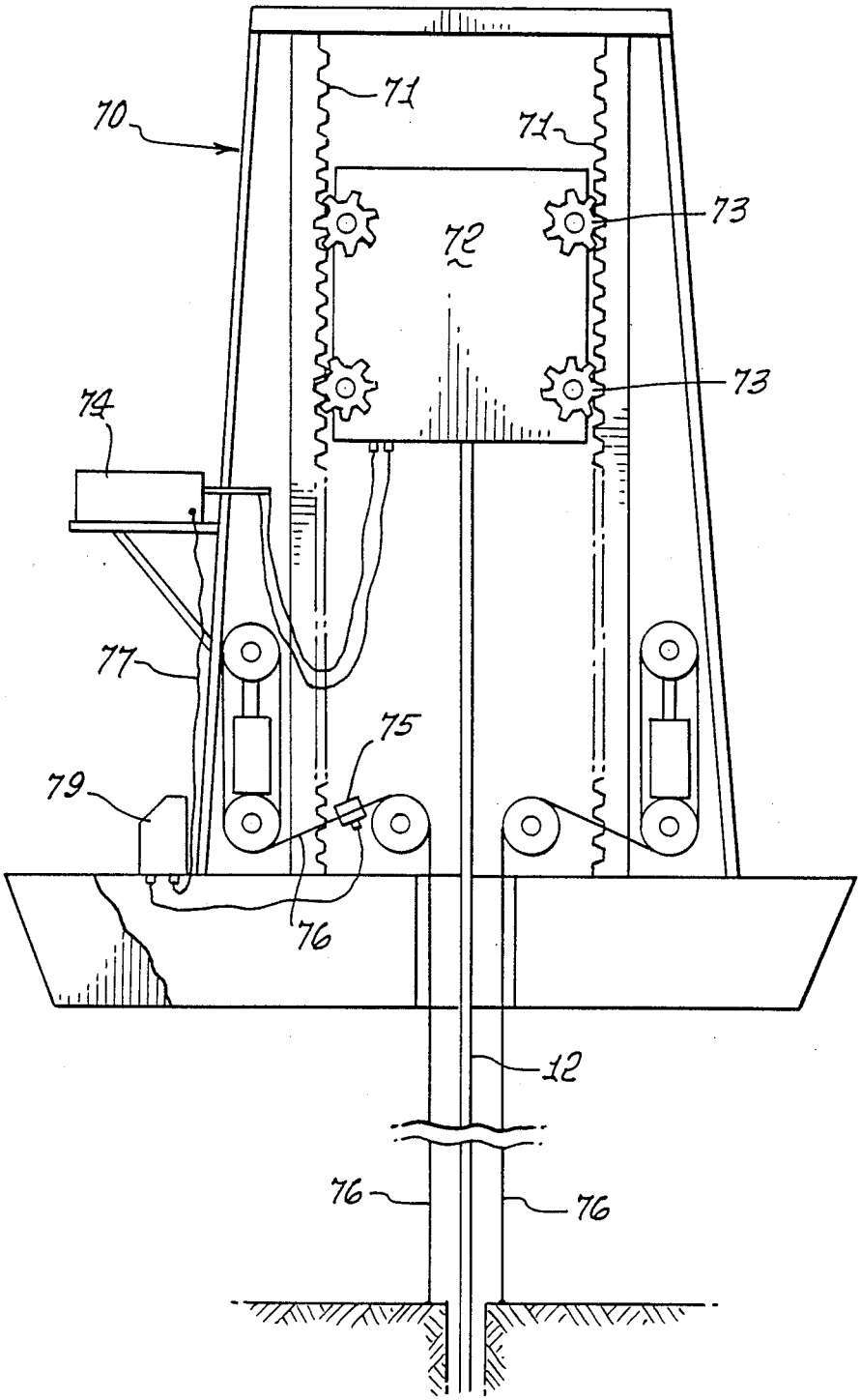
FIG. 3 is a view like FIG. 1 but showing a rack and pinion compensator.
Figure 4:
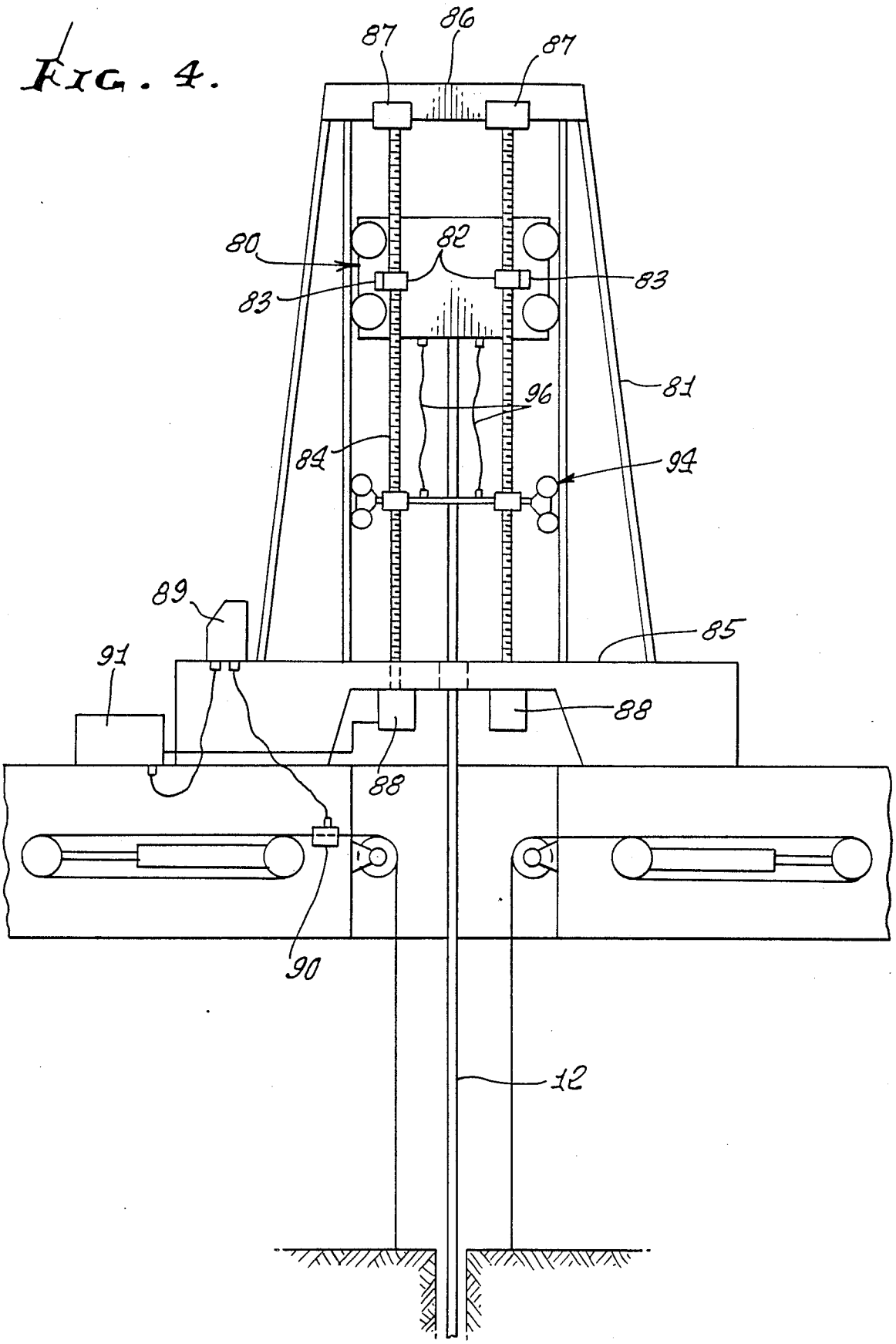
FIG. 4 is a view like FIG. 1, but showing a vertical screw compensator.

Other possible designs are illustrated in FIGS. 3 and 4. These designs lend themselves to new rig construction, rather than retrofit to existing floating rigs. Following are component and function descriptions of the principle equipment involved in each design.

Taking into consideration that active compensation manipulation in the form of either of these two methods (employing constant torque drive) will compensate for any deviation in the vertical motion or suspended weight; the desired area of compensation becomes the entire vertical requirement of the drilling operation. Consequently, the rack design of FIG. 3, or lead screw design of FIG. 4, will extend the entire height of the derrick or mast. In this configuration, the compensator, by virtue of being able to assume the entire suspended load, can replace the conventional hoisting equipment inclusive of the derrick structure itself. The net result is an independent full travel compensated derrick or drilling tower. Since the device method remains the same and only the application changes, the description and sketches illustrate the full compensation method.

The rack and pinion design is illustrated in FIG. 3 and the equipment descriptions are as follows:

Item 70—Fixed drilling tower fitted with rack gears 71.

Item 72—Compensation head. This device is the motion compensator. It is floating on the rack gears and is positioned by constant torque pinion gears 73 that allow compensation to occur throughout the entire vertical travel in the derrick structure. Head 72 supports string 12.

Item 74—Hydraulic power unit, which provides the hydraulic power necessary to provide motion compensation and hoisting of the compensation head, via hydraulic motor driven pinions 73.

Item 75—Motion encoder to encode mechanical motion of cable 76 into an electronic signal. Device measures displacement, velocity, acceleration and direction of relative cable travel, for active compensation.

Item 79—Signal processor. A device to filter, process and amplify the electronic signal into a driving signal for the proportional servo hydraulic system. See lead 77 from 76 to 74.

The system takes its motion signal from the guideline or riser tensioner line 76, in the same manner as described before. Operation will also be as described previously. Dual lines 76 provide balance.

Another method of accomplishing the same task is the Drive Screw Method. The system is illustrated in FIG. 4. The description and function of the principle components is as follows:

Item 80—Compensating head. This device is the motion compensator. It is floating in a guide system in the fixed derrick structure 81, and supports string 12. It is held in position by nuts 82 running on the lead screw(s). These nuts are attached in floating supports 83 that allow some relative motion between the screws and the compensating head.

Item 84—Lead screw(s), comprising threaded shaft or shafts reaching the entire length of the derrick, i.e., from drill floor 85 to crown beams 86. Rotation of these screws, in bearings 87, provides the vertical/axial movement of the compensating head.

Item 88—Drive devices, i.e., hydraulic or electric motor(s) to impart rotational motions to the lead screw(s). These motors are carried by the vessel.

Item 89—Signal processor, a device to filter, process and amplify the electronic motion signal from encoder 90 into a driving signal for the hydraulic system or motor control center 91.

Item 91—Hydraulic power unit or motor control center that provides the hydraulic power and/or motor control to effect the motion of the drive devices 88.

Item 90—Encoder device, as described above.

Item 94—Floating oscillation restraint means to restrain the lateral oscillations that may be present in a long, slender rotating shaft. The shaft below the compensating head is loaded only in torsion and may be subject to oscillations due to length, balance and moment of inertia considerations. The restraint device or means is fixed to the compensating head via chains or cables 96 (see FIG. 5) and will be activated when a critical length of lead screw is "exposed". The restraint will be guided in the same tracks 97 in vertical guides 98 as the compensating head, but this may be varied. Note unit 99 connected to 94 and threadably engaging 84 to ride up and down, with 80.

FIG. 6 shows a single-ended actuator 110 which includes an outer cylinder 111, a central tube 112 in cylinder 111 and attached thereto at base 112; and a tubular member 113 fitting in the annulus between 111 and 112. A piston 114 on 113 slides between surfaces 115 and 116, and has seals 117 and 118.

Fluid pressure entering space 119 at 120 pushes down on the piston surface 121; and fluid means entering space 122 via the tubular member 113 and port 123 pushes up on surface 124. Surface 121 has area $A_1$, and surface 124 has area $A_2$, and $A_1 = A_2$. If pressure on $A_1$ exceeds that in $A_2$, the actuator extends and vice versa. Either of the cylinders 51 in FIG. 1 can be replaced by the FIG. 6 cylinder.

We claim:

1. In a motion compensation system for use on a drilling vessel that is subject to heaving due to wave actions, and wherein a motion compensator associated with a derrick supports a drill string that extends from the vessel downwardly through the seabed and into a drilled hole in the subsea formation, the compensator having rod supported sheave means, the combination that includes (a) first means for sensing vertical motion of the vessel, due to said heaving, and for producing a signal that varies in response to said sensing, (b) second means on the vessel for producing hydraulic fluid displacement corresponding to varying of said signal, (c) and hydraulic fluid responsive manipulator means in the form of an actuator or actuators carried by the derrick and operatively connected to the compensator rod supported sheave means for manipulating said compensator vertically in correspondence to said hydraulic fluid displacement, thereby to maintain the drill string substantially motionless vertically, (d) said compensator including cables and pulleys, and a frame connected with said cables and pulleys and said manipulator means includes at least two vertical actuators each including cylinder and plunger elements, one of the elements connected to the compensator rod supported sheave means and the other of the elements connected to the frame, (e) said second means including an hydraulic fluid pump, and a four-way directional control valve connected between the pump and the actuator means for controllably delivering pressure to opposite ends of the actuators in response to shifting of the valve which is so shifted in response to variations in said electrical signal.

2. The combination of claim 1 wherein said actuators each include telescoping piston and cylinder members, the piston member being cylindrical to telescopically receive a central plunger carried by the cylinder member.

3. The combination of claim 1 above the cylinder and plunger elements are one of the following:

double ended single ended.

4. In a motion compensation system for use on a drilling vessel that is subject to heaving due to wave actions, and wherein a motion compensator associated with a derrick supports a drill string that extends from the vessel downwardly through the seabed and into a drilled hole in the sub-sea formation, the combination that includes (a) first means for sensing vertical motion of the vessel, due to said heaving, and for producing an electrical signal that varies in response to said sensing, (b) second means on the vessel for producing hydraulic fluid displacement corresponding to varying of said signal, (c) an actuator means in the form of an actuator or actuators carried by the derrick for lifting and lowering said string relative to the vessel to maintain the drill string substantially motionless vertically, (d) said actuator or actuators including interengaged nut and vertical screw elements, one of the elements carried by the derrick, and the other of the elements supporting the drill string, the actuator means operatively connected to the screw element or elements to rotate same.

5. The combination of claim 4 including oscillation restraint means operatively connected with the screw element or elements to restrain lateral oscillations thereof.

6. The system of claim 4 wherein the screw element or elements have vertical extent substantially equal to the vertical extent of the derrick.

7. The system of claim 4 wherein said (a) means includes dual lines connected with the seabed and tensioner on the vessel connected with said lines, and an encoder on the vessel sensing relative motion between a line and the encoder.

8. In a motion compensation system for use on a drilling vessel that is subject to heaving due to wave actions, and wherein a motion compensator associated with a derrick supports a drill string that extends from the vessel downwardly through the seabed and into a drilled hole in the sub-sea formation, the combination that includes (a) first means for sensing vertical motion of the vessel, due to said heaving, and for producing an electrical signal that varies in response to said sensing, (b) second means on the vessel for producing hydraulic fluid displacement corresponding to varying of said signal, (c) and actuator means in the form of an actuator or actuators carried by the derrick for lifting and lowering said string relative to the vessel to maintain the drill string substantially motionless vertically, (d) said actuator or actuators including interengaged rack and pinion elements, one of the elements carried by the derrick, and the other of the elements supporting the drill string, the actuator means operatively connected to the pinion element or elements to rotate same.

9. The system of claim 8 wherein the rack element or elements have vertical extent substantially equal to the vertical extent of the derrick.

* * * * *